US006260748B1

(12) United States Patent
Lindsey

(10) Patent No.: US 6,260,748 B1
(45) Date of Patent: Jul. 17, 2001

(54) WEAPON SLING AND ATTACHMENTS

(76) Inventor: Forrest R. Lindsey, 4843 Keswick Ct., Dumfries, VA (US) 22026

( * ) Notice: Subject to any disclaimer, the term of this patent is extended or adjusted under 35 U.S.C. 154(b) by 0 days.

(21) Appl. No.: 09/119,402

(22) Filed: Jul. 21, 1998

(51) Int. Cl.[7] ..... F41C 23/02
(52) U.S. Cl. ..... 224/150; 224/258; 224/913
(58) Field of Search ..... 224/150, 913, 224/257, 258, 250; 24/215; 42/94, 85

(56) References Cited

U.S. PATENT DOCUMENTS 2,647,667 * 8/1953 Brown et al. ..... 224/913
3,495,770 * 2/1970 Seltmann, Jr. et al. ..... 224/150
5,303,859 * 4/1994 Jenkin ..... 224/150

* cited by examiner

*Primary Examiner*—Stephen K. Cronin
(74) *Attorney, Agent, or Firm*—Ronald B. Coy, Esquire

(57) ABSTRACT

A weapon sling includes a cross body loop with a length adjustment and lower sling attachment for the rear end of a weapon. The length of the loop can be adjusted to conform to individual body sizes. The upper end of the loop has a clasp and an extension strap affixed thereto. The opposite end of the strap has a mating clasp for the clasp on the loop and an upper attachment for attaching to the front end of a weapon.

14 Claims, 8 Drawing Sheets

WEAPON SLING AND ATTACHMENTS

FIELD OF THE INVENTION

This invention relates to an improved weapon carrying sling which, upon release, lengthens to form a firing support. The invention further relates to improved attachments which fasten the ends of the sling to the top and bottom or butt and forearm areas of the weapon.

The improved sling is useful in military, hunting and target weapons in general while the attachments and the sling together are particularly useful on the rifle currently in use in the United States Military and in the armed forces of other nations known as the M-16 rifle and the M-4 carbine and their equivalents.

PRIOR ART

For many years carrying slings or straps have been used on weapons such as rifles and other guns which enable them to be carried diagonally on an individuals back, over one shoulder on the back vertically, or over the front of the body. These slings generally utilize some form of flexible strap attached near the top or forearm part of the weapon and run to some attachment point at or near the butt or pistol grip of the weapon, and are usually adjustable in length to adapt to the size of the individual, weapon type or to the carrying position.

It is also known to provide some means to lengthen the strap to enable the weapon to be shouldered, or at least the barrel extended forward of the individual's body, for firing wherein the lengthened strap forms a firing aid in that the strap about the individual's body is tensioned or strained off against the attachment to the forearm area steadying the front of the weapon, thus improving accuracy.

R. H. Seltmann et al, U.S. Pat. No. 3,495,770; Bennett, U.S. Pat. No. 4,182,469; and Rock, U.S. Pat. No. 5,433,360 all disclose related weapon slings which use a sling or body loop which carries the weapon over the front of the individual's body. The loop circles the individuals chest and back and hangs over one shoulder. The butt of the weapon is supported by an attachment to the bottom or hip end of the loop. The encircling loop of these patents generally terminates at the aforesaid shoulder in two ends. One end of the loop passes through a slider or noose affixed at the other end of the loop at the individual's diagonal shoulder and goes on through the slider to attach to the forearm of the weapon. When firing, the forearm of the rifle is extended which retracts the slider end and slider towards the individual's body along the other end of the loop and tightens the sling through the slider to provide firing support by straining off the tightened body loop through its end connected to the weapon forearm.

To carry the weapon, a clasp is provided at or near the weapon forearm attachment point which, when clasped to the slider or noose, brings the rifle forearm up toward the individual's shoulder into generally a front carrying position while loosening the body loop.

German Patent #2,260,700, discloses a sling in which a back strap 5 and loop 4 extending only across the individual's back carries the weapon with an attachment at the shoulder end of the loop. The strap 5 is clasped to the forearm to carry the weapon and released to tighten the loop 4 through the attachment and form a firing support.

A major problem with the above noted sling types is that the release of the weapon from the carry position and tightening of the body loop or back loop in the case of the German patent, causes a trade off in the "feel" of use of the sling as a firing support because changing the tension against the weapon forearm causes a change in the tension or tightness of the body loop and vice versa which adversely affects the aim because of such simple activities as breathing and wearing of body equipment, armor, or even coats and a loose carry position when clasped which allows the weapon too much freedom to move about the individual's body.

Additionally, this interdependence causes problems in that an adjustment in the body loop changes the length of the firing support appreciably. In the case of the German patent, there is also no full body loop, which leaves the weapon inadequately supported in both the carry and firing positions.

U.S. Pat. No. 5,303,859 discloses a forearm sling attachment by which means a circular ring forming the sling attachment point is inserted over the end of a shotgun magazine tube at the forearm.

Additionally U.S. Pat. No. 4,249,686 to Morwood discloses a weapon sling with a loosely encircling body loop from which the weapon may be carried across the front of the body and utilizing a releasable second strap between the shoulder end of the body loop and the weapon forearm. This second strap is released to fire the weapon but then provides no firing support. Note, however, in FIG. 7 a mode is disclosed whereby the entire body loop can be used as a firing support, though in a manner entirely unlike the invention herein disclosed.

Further, an attachment to this application dated May 25, 1970 and found in the Examiner's search area in Class 224 Subclass 150 shows a weapon sling adapter kit, including a sling forearm attachment adapter capable of attachment to the front sight bridge of the M-16 type rifle.

DESCRIPTION OF THE PREFERRED EMBODIMENT

Figure 7:
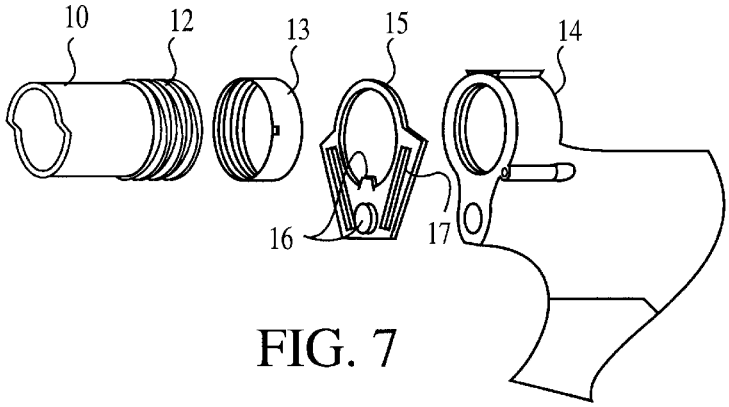
FIG. 7 shows the lower sling attachment adapter in an exploded view for assembly on the M-4 carbine or its equivalent.
Figure 8:
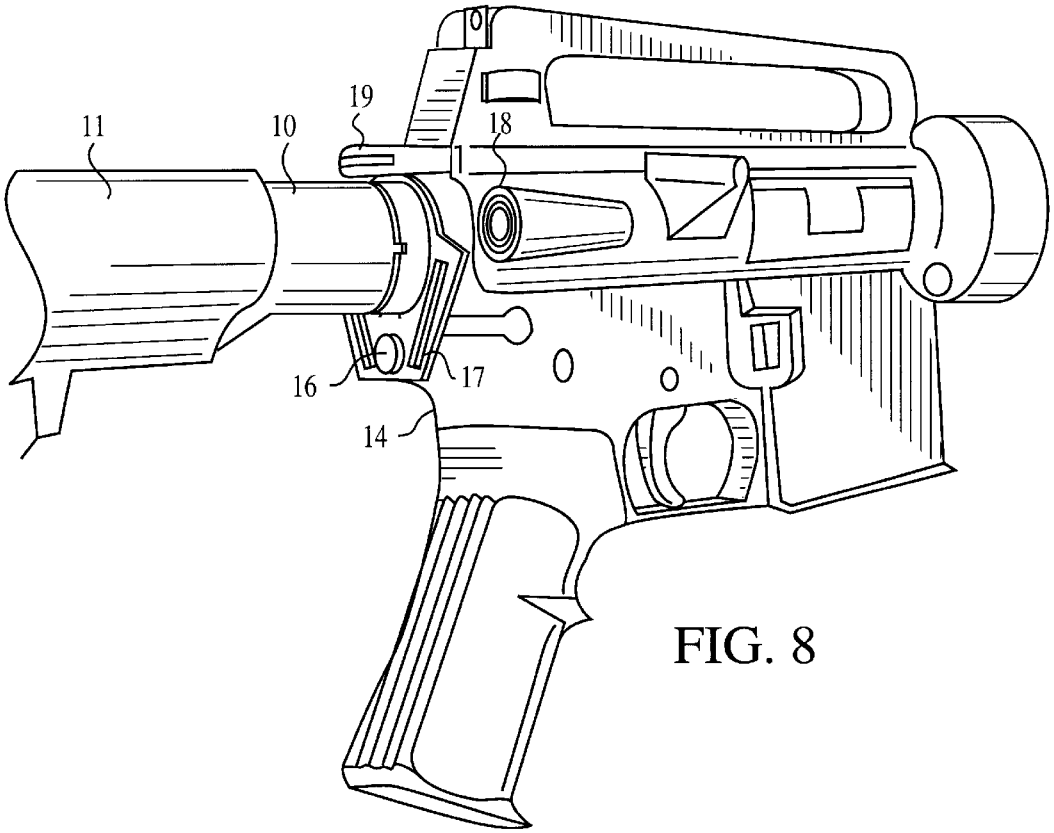
FIG. 8 shows the existing lower butt stock of the M-4 type carbine with the lower sling adapter attached.
Figure 9:
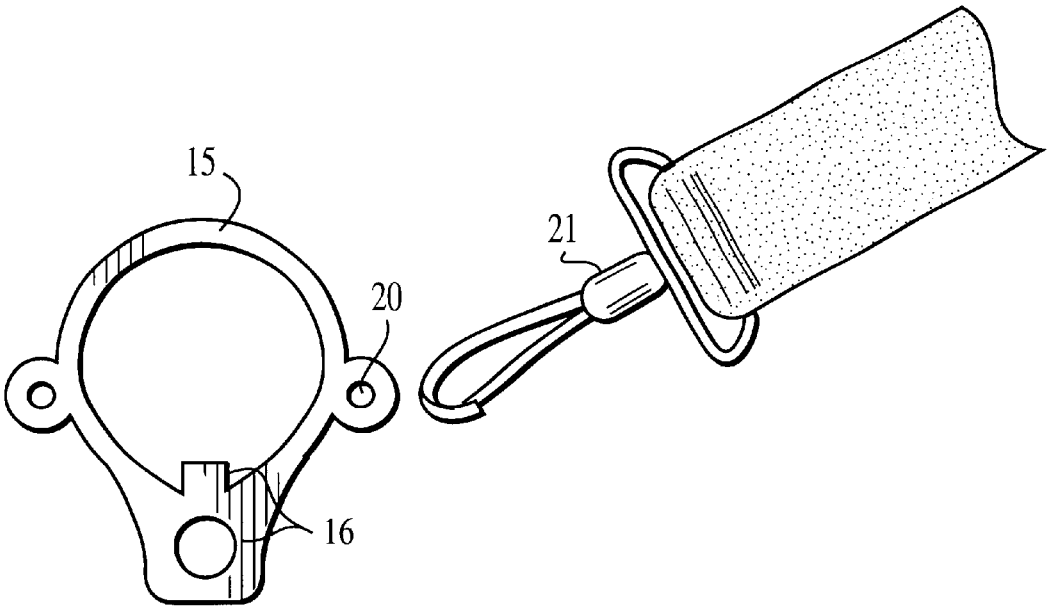
FIG. 9 shows an alternative lower sling attachment adapter for the M-4 type carbine.
Figure 10:
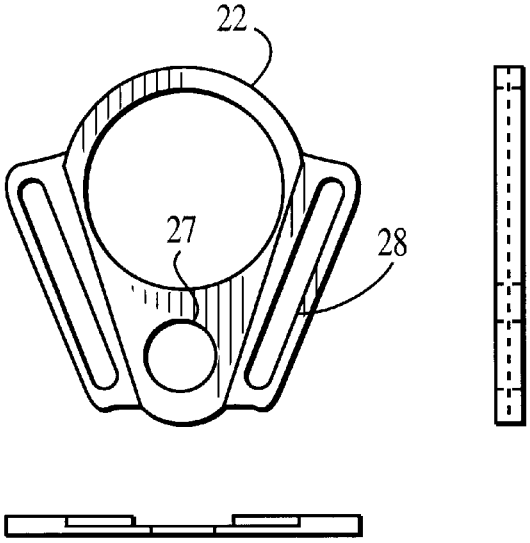
FIG. 10 shows the lower sling attachment adapter for use with the M-16 rifle or its equivalent.
Figure 11:
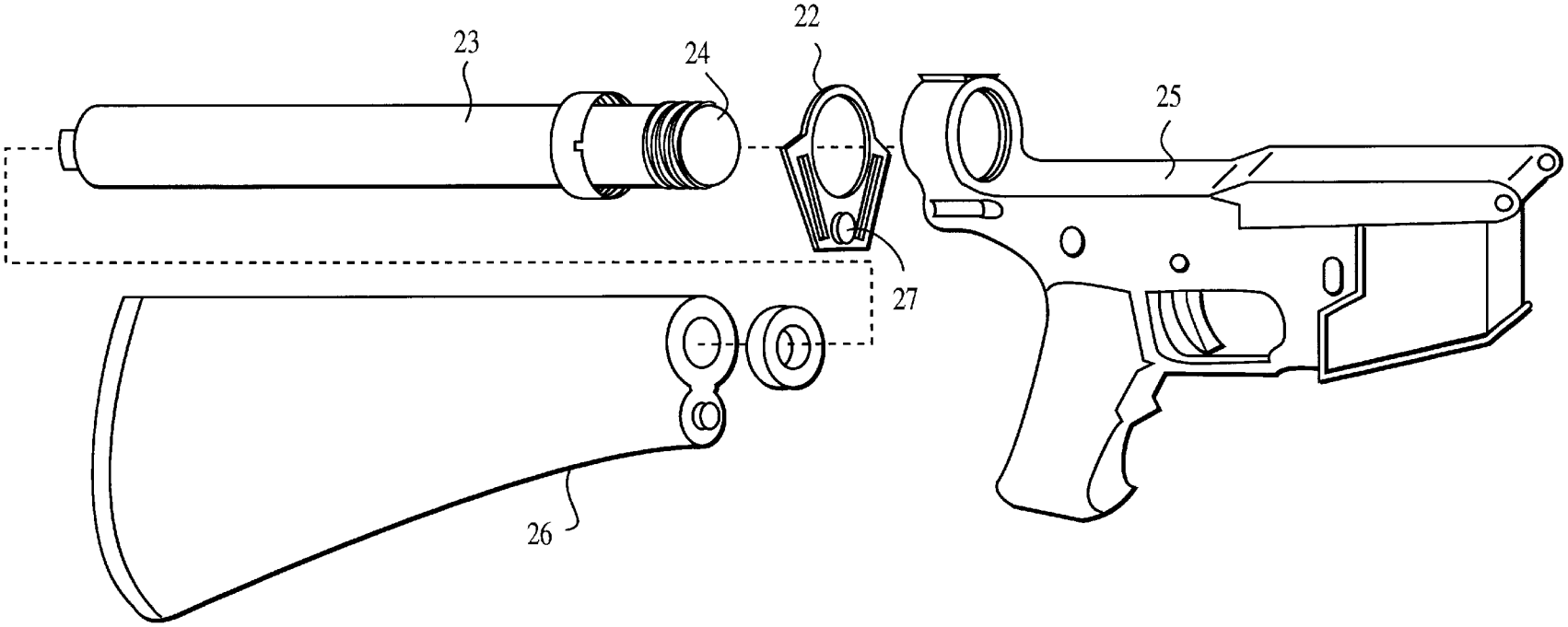
FIG. 11, shows the lower butt stock of the standard M-16 rifle in an exploded view of the assembly of the lower sling attachment adapter of FIG. 10.

The weapon sling of the invention includes, referring to FIGS. 1–5, a cross body loop 1 with a length adjustment 2 and a lower sling attachment 3 for attachment to the lower end of the weapon, such as the butt or pistol grip area, which can be the lower attachment adapters of FIGS. 7–9 for the M-4 type carbine or the lower attachment adapter of FIGS. 10–11 for the M-16 type rifle.

The length of this loop can be adjusted by adjustment 2 to conform to individual body size, weapon type, other equipment being carried or various carrying positions and may be of the usual buckle type. In use in the transport or firing of the weapon, however, the length of loop 1 is fixed.

The upper or shoulder end of loop 1 has both a clasp or catch 4 affixed thereto as well as an extension strap 6. The strap 6 carries near its end away from loop 1 a mating end 5 of catch 4 and an upper attachment 7 for attachment to the front or forearm area of the weapon which may be the upper sling attachment adapter shown in FIGS. 13–15. Further, the strap 6 may itself have a length adjustment means 8 such as a common belt buckle type, fabric hook and pile closure, etc. so that its length is adjustable entirely independently of the length of loop 1. This gives the invention particular adaptability to use with various different weapons and weapon attachments, different firing positions preferences as well as individual user sizes and other equipment which may be carried by the user yet means that the weapon can be carried snugly against the body with no interdependence of the firing position on the carry position.

In practice, the catch 4 can alternatively be attached to the extension strap 6 near its attachment to loop 1 and the mating end 5 can alternatively be attached to the weapon forearm or barrel.

Figure 1:
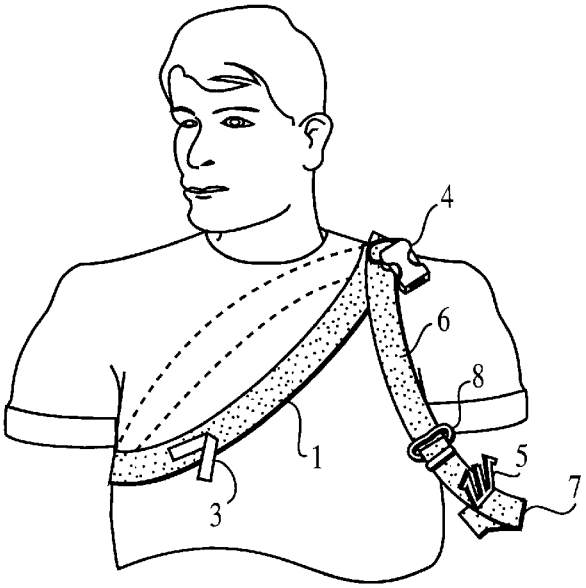
FIG. 1 shows the weapon carrying sling of the invention without the weapon attached and showing the encircling body loop with the forearm attachment unlocked to firing position.
Figure 2:
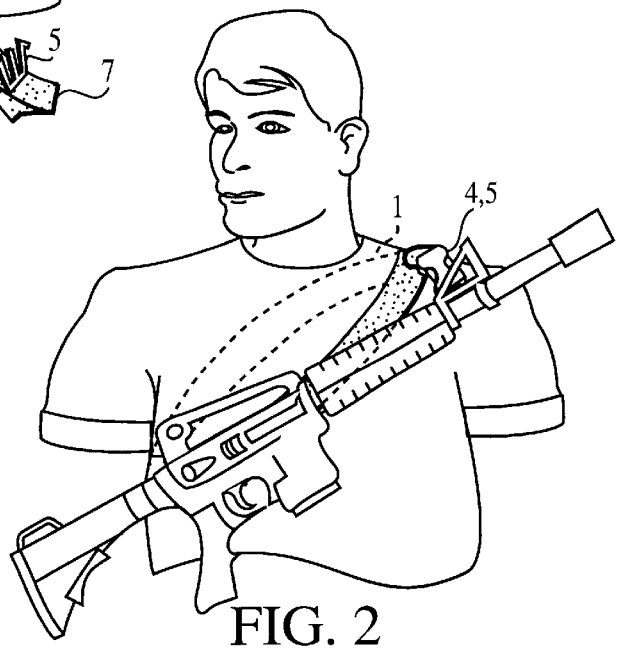
FIG. 2 shows the sling with weapon attached and in locked or carry position.

In use in the carrying position with the weapon in front of the body as shown in FIG. 2, the clasp mating end 5 is inserted in catch 4 which effectively forms a loose second loop of strap 6 and brings the weapon barrel up out of the way of the arms, etc. and into an easy but snug carrying position.

Figure 3:
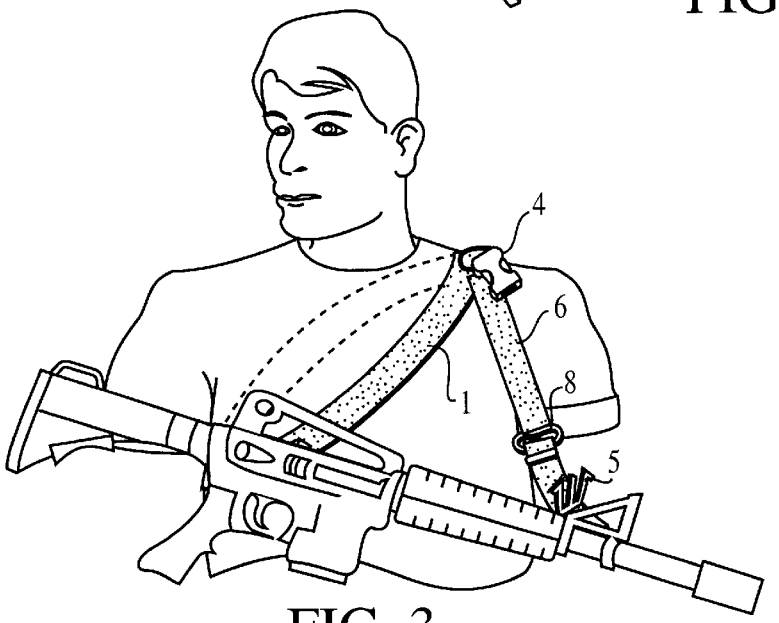
FIG. 3 shows the sling with weapon attached in unlocked or ready to fire position.
Figure 4:
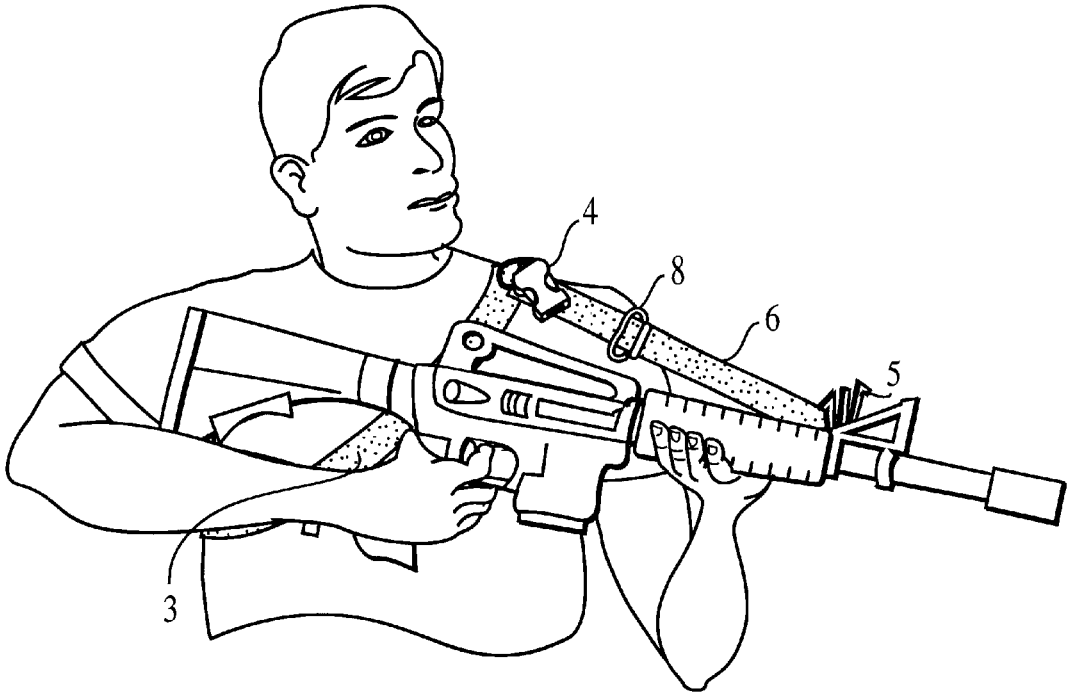
FIG. 4 shows the sling in unlocked firing position with the sling steadying the weapon.

In use in the firing position, the catch 4 is released which drops the weapon into the position shown in FIG. 3 in which it can be shouldered and fired or steadied by straining against strap 6 and fired. The same may be accomplished by firing unshouldered, or even with one hand.

The catch 4 can be of the positive latching type which requires the individual to release it by hand or may be of the pressure release type which will release when the individual simply pushes on the weapon itself.

Figure 5:
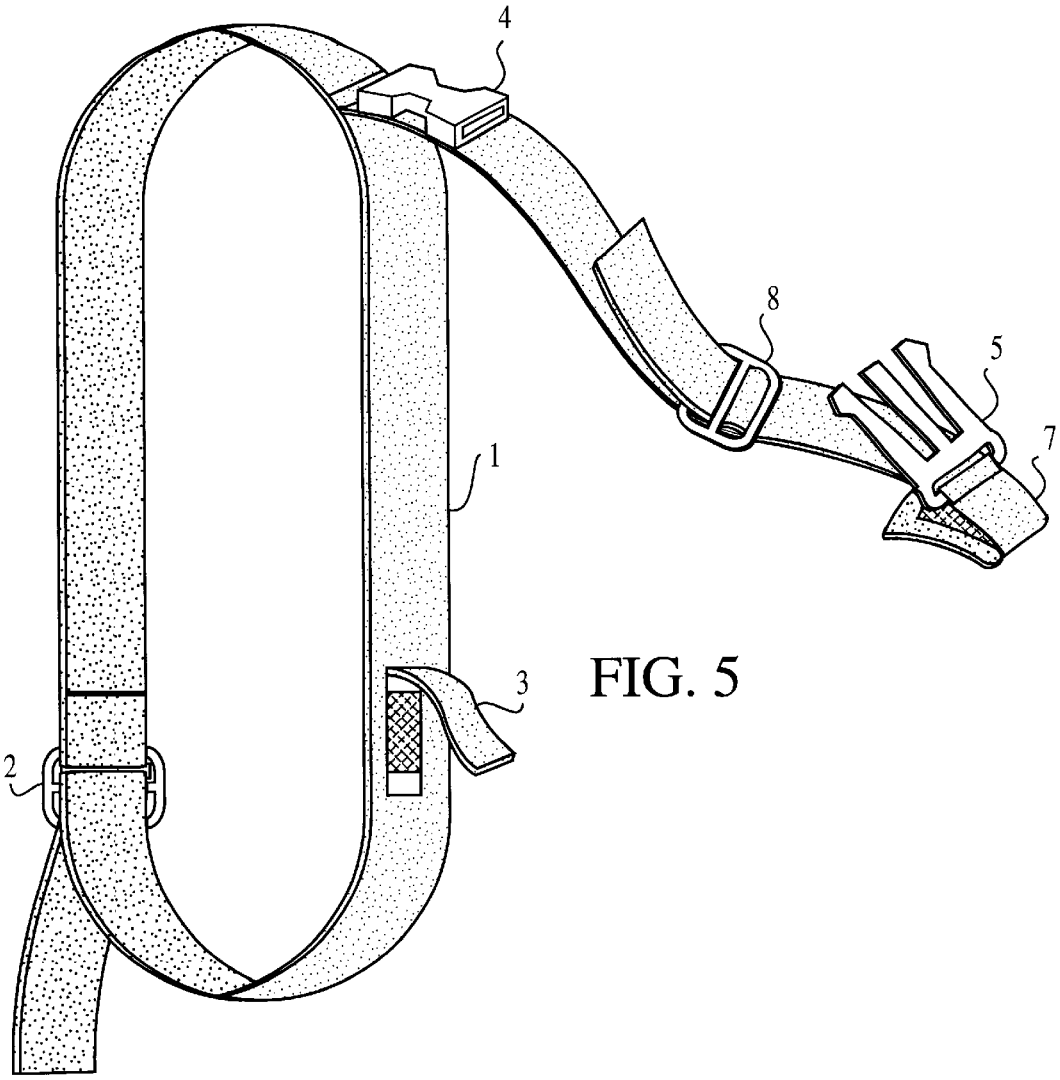
FIG. 5 shows a more detailed view of the sling and release catch without the weapon attached.
Figure 6:
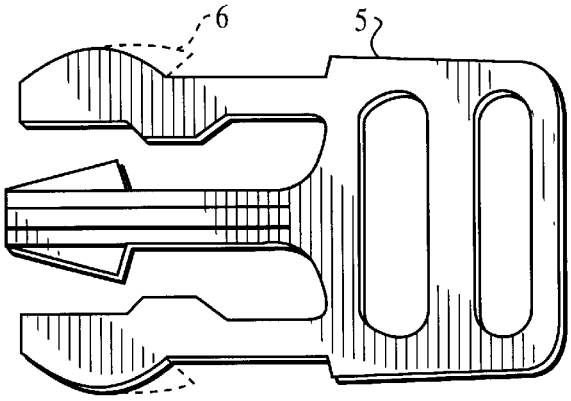
FIG. 6 shows a detailed view of a version of the male end of the release catch.

FIGS. 5 and 6 show a type of common positive release catch which has a mating end 5 with barbs 9. These catches are often made of plastic. It has been found that a particularly satisfactory pressure release catch can be made by the removal of barbs 9 as shown in FIG. 5 by filing etc. This results in a simple light, quiet, and inexpensive catch which will hold the weapon in carry position until the user exerts a considerable positive push on the upper end of the weapon. This is particularly useful in a military situation if the user is wounded or in a situation where there is a need to fire with one hand such as driving a vehicle. Other known types of catches such as fabric hook and pile attachments or cam latches could also be used, however.

While the weapon sling has most obvious use in the front carry diagonal position shown, it can also be used to carry the weapon in the diagonal position on the individuals back or vertically over the shoulder.

When used in its preferred use as a front carry sling the sling attachments 3 and 7 should attach to the weapon so that the center of gravity of the weapon and any attachments or accessories such as thermal sights, telescopic sights, night vision devices, laser pointing devices, and grenade launchers, or even flashlights is under a line between the attachment points in order that the weapon will be carried in an upright position and is ready for use. The upper and lower sling attachment adapters disclosed are particularly useful in this regard in the M-16 and M-4 type weapons.

The current rifle and carbine in use in the United States Armed Forces is the M-16 rifle and the M-4 carbine. These weapons or equivalent designs are also used by a number of other countries.

The M-4 carbine rear or butt stock as shown in FIGS. 7 and 8 has a spring and buffer tube 10 which also carries the extendable butt stock 11 of the weapon at its rear end. This tube 10 has a threaded portion 12 at its other end on which is carried a threaded lock ring 13, and a washer, not shown, and is threaded into the rear of the receiver 14. All of the above parts are standard in this weapon as is a lower sling attachment often mounted on the top rear of the butt stock 11.

It has been found that a lower sling attachment adapter such as 15 shown in FIG. 7 has particular adaptability to this weapon and to the sling disclosed above in that it is easily installed on the M-4 weapon by loosening or unscrewing 13, inserting the adapter 15 in place of the existing washer, and reinstalling the lock ring 13 and tube 10. The adapter is located against rotation on the tube 10 by locators 16 which consist of a key mating with a slot in tube 10 and a detent mating with a matching detent on receiver 14 as in the standard washer which it replaces. The adapter 15 includes an elongated slot 17 on either or both sides of the lower portion of adapter as shown in FIGS. 7 and 8 so that the web of the end of attachment 3 can be passed through either of the slots 17 depending on whether the weapon is to be carried or used from the right or left handed position. The lower mounting of slots 17 prevents interference by the sling with the existing weapon controls such as the bolt assist 18 or charging handle 19.

FIG. 9 shows the adapter 15 with simple holes 20 on either side rather than the slots of FIGS. 7 and 8 which can be used with the common clip type of sling end attachment 21 at the lower attachment point 3 of loop 1.

FIG. 10 shows an alternate lower sling attachment adapter 22 which has particular adaptability to the M-16 type rifle lower receiver and butt stock, as shown in FIG. 11. FIG. 10 shows front, side and end views of the lower sling attachment adapter 22 as it is configured for use on the M-16 rifle and its equivalents. In FIGS. 10 and 11, the mounting is similar to the M-4 carbine in that tube 23, which has a threaded end 24 ahead of a shoulder, is passed through adapter 22 and is threaded into receiver 25 as shown in FIG. 11 in which all parts shown other than adapter 22 are standard on this weapon. The butt stock 26 of the rifle is mounted on the tube 23. The adapter 22 is held against rotation on the tube 23 by a locator hole 27 which mates with a mating locator on stock 26 which protrudes through hole 27 and into a mating hole in receiver 25. Whereas in the M-4 assembly the adapter was a replacement for an existing washer, in the M-16 assembly the adapter 22 is an addition to the standard parts shown in FIG. 11 and is clamped by tube 23 to receiver 25 with the existing locator on stock 26 passing through it to receiver 25. Adapter 22 is machined as shown in the views of FIG. 10 to clear and mate with the existing parts shown in FIG. 11 in known fashion. Slots 28 are provided in adapter 22 for mounting to the end of lower sling attachment 3. Simple holes and clips could also obviously be used as set out in FIG. 9.

Figure 12:
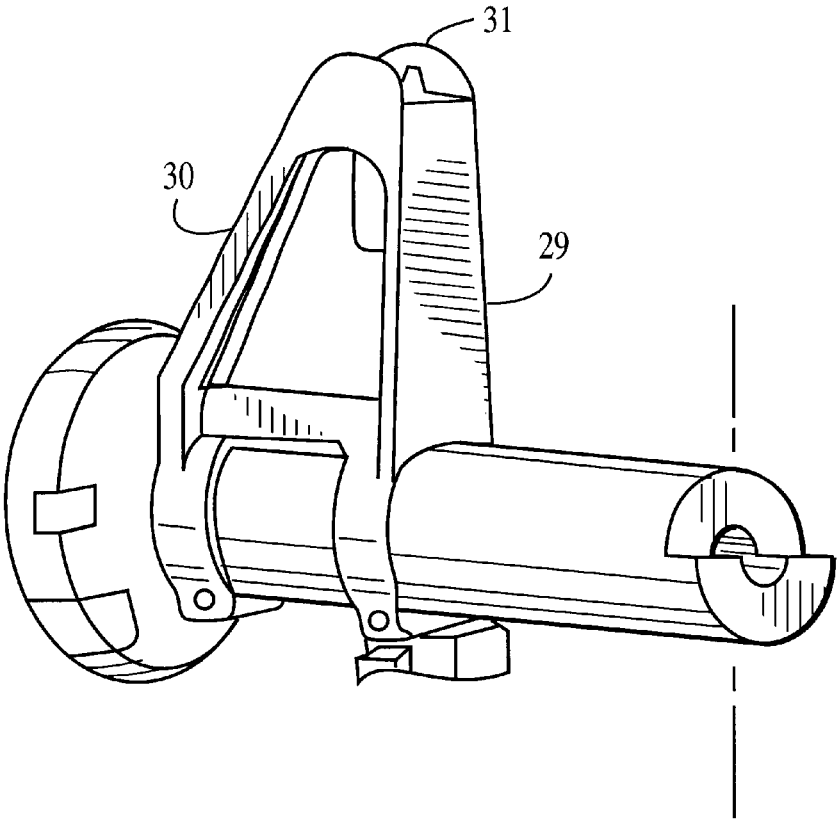
FIG. 12 shows the front sight bridge of the existing M-4 type carbine and M-16 type rifle.

FIG. 12 shows the standard front sight bridge in use in the M-4 and M-16 weapons which consists of a front leg 29 and a rear leg 30 which support a front sight 31.

Figure 13:
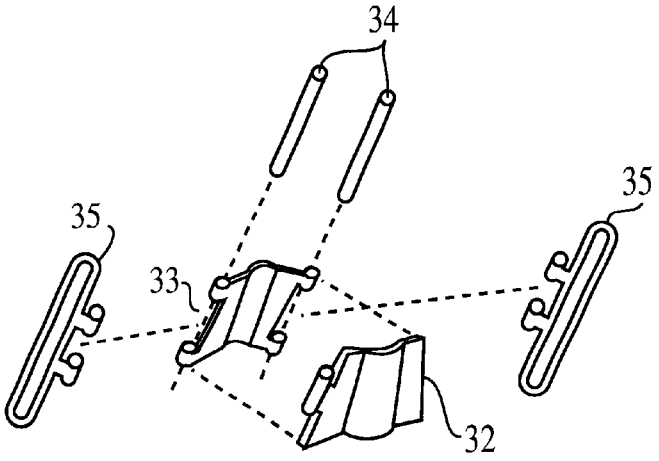
FIG. 13 shows an exploded view of the upper sling attachment adapter of the invention for attachment to the rear leg of the front sight bridge of existing M-4 type carbines and M-16 type rifles.
Figure 14:
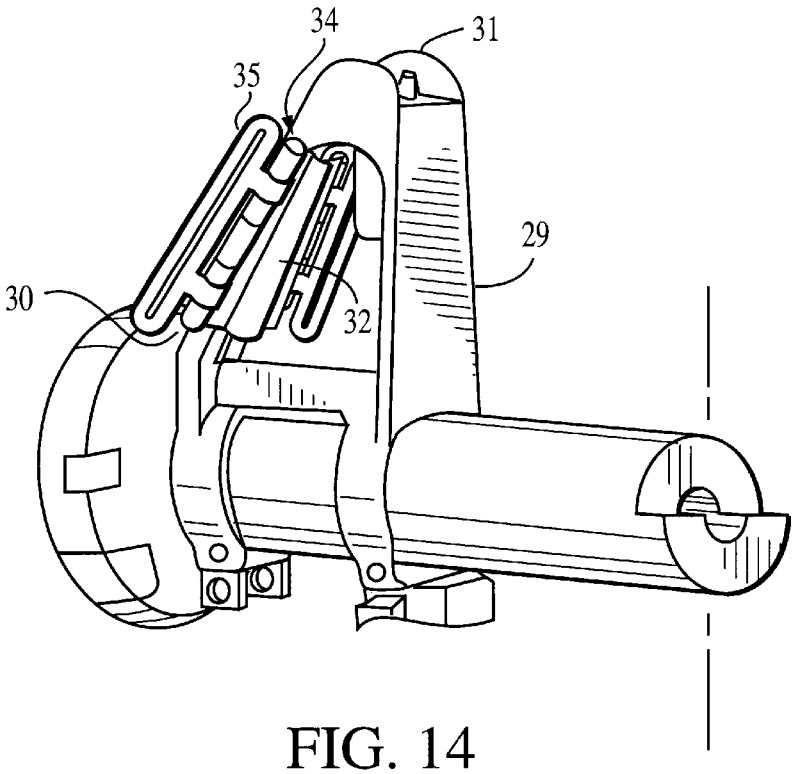
FIG. 14 is a front view of the upper sling attachment adapter attached to the rear leg of the front sight bridge of the M-16/M-4 type weapons.
Figure 15:
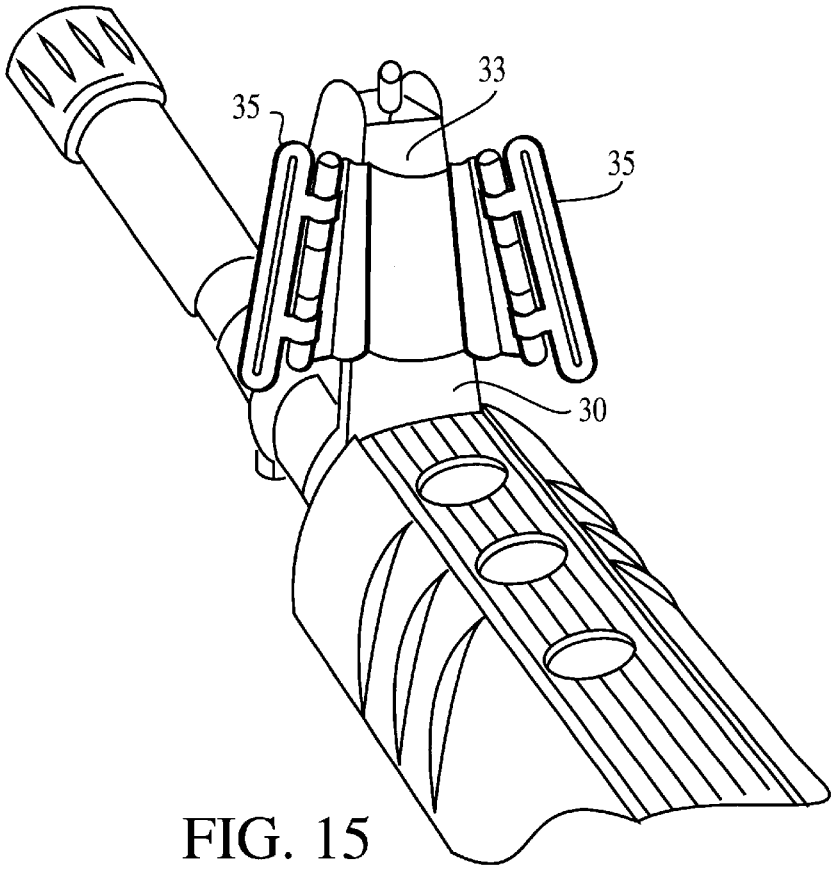
FIG. 15 shows a rear view of the mounted upper sling attachment adapter attached to the front sight bridge rear leg.

The upper sling attachment adapter of FIGS. 13–15 has particular adaptability to the M-4 and M-16 type of weapon and to the sling described above. The M-4 and M-16 weapons both utilize a front sight 31 mounted on front and rear bridge legs 29 and 30 as shown in FIGS. 12, 14, and 15. The upper sling attachment adapter shown in exploded view in FIG. 13 consists of front and rear sections 32 and 33 which encircle the rear sight bridge leg 30 and carry mating extensions on each side. The front and rear sections are attached to leg 30 and pinned together by pins 34 which are pressed or driven in place through the mating extensions and which also carry sling ears 35 which may swivel on said pins. Pins 34 may be replaced by screws or may be locked in place by pins or clips in a known fashion.

The upper sling attachment adapter is thus easily attached to the existing front sight, however, ears 35 could obviously be produced as a casting or stamping as an integral part of front or rear legs 29 and 30.

The inventive sling itself is useful with sporting as well as military and target weapons. It enables the weapon to be comfortably carried with other equipment and weapon attachments and yet to be quickly brought to firing position. The weapon can be fired from one hand while the other is used to steady the user as in vehicles, when rapelling, or climbing, or when wounded. Further the sling is quickly adaptable for right or left hand carry and firing. The combination of the inventive sling and the upper and lower sling attachment adapters with the M-16 and M-4 weapons produce a sling system which has particular benefit for military use in that a number of problems with existing slings and adapters are overcome.

Current military weapons often use large night sights, laser sights, etc. which are difficult to carry and use with existing slings. The upper and lower sling attachment of the invention result in the weapon being carried upright rather than being overweighted by the attachments and turned over. Further, the upper sling attachment adapter tends to keep the sling out of the line of sight when the weapon is being aimed as opposed to prior slings.

I claim:

1. A weapon carrying and firing sling comprising a body loop for encircling the body of an individual carrying the weapon, said body loop having a lower end and an upper end passing over one of said individual's shoulders, said body loop also having a lower attachment means located at said lower end of said body loop for attachment near the lower or butt end of a weapon, a first release clasp means affixed to said body loop near its upper end, an extension strap having a first end fixedly attached to said body loop near said upper end and a further distant end on which is mounted an upper attachment means for fixed attachment to the upper or forearm area of the weapon, so that, when the sling is in use on the individual, the length of the extension strap is of fixed relation to the length of the body loop and the said distant end of the extension strap is always attached to the weapon forearm, a second release clasp means adapted to engage and clasp with said first release clasp means and mounted near the upper or forearm area of the weapon wherein the first and second clasp means are clasped to form a loop by joining the said first and further ends of said extension strap when carrying the weapon and, when released, to extend said loop to allow the weapon forearm to be extended away from the body for firing and strained against said extension strap for steadying the weapon when firing.

2. The weapon carrying and firing sling of claim 1 wherein the second release clasp means is mounted on said extension strap near said distant end.

3. The weapon carrying and firing sling of claim 1 wherein said first release clasp means is mounted on said extension strap near its first end.

4. The weapon carrying and firing sling of claim 1 wherein said extension strap has adjustment means to adjust its length.

5. The weapon carrying and firing sling of claim 1 wherein said first and second release clasp means are adapted to release at a predetermined tension in said extension strap.

6. The weapon carrying and firing sling of claim 1 wherein said first and second release clasp means are adapted to release with hand pressure from the individual on one of said release clasp means.

7. The weapon carrying and firing sling of claim 1 wherein, when said first and second release clasp means are unclasped, said extension strap is strained against said body loop to steady the weapon on firing.

8. The weapon carrying and firing sling of claim 1 wherein at least one of lower and upper attachment means use fiber hook and pile closures.

9. The weapon carrying and firing sling of claim 1 wherein the upper and lower attachment means attached to the weapon are so located that the center of gravity of the weapon and any mounted accessories lies below a straight line running from the upper to the lower attachment means whereby the weapon will be carried by the sling in a trigger down position.

10. The weapon carrying and firing sling of claim 1 wherein said body loop has adjustment means to adjust its length.

11. The weapon carrying and firing sling of claim 10 wherein said extension strap has adjustment means to adjust its length.

12. A weapon carrying and firing sling for use in the M-16 type rifle and M-4 type carbine utilizing a rear or butt stock mounted on a tube, one end of which tube is threaded into the rear of the receiver of the weapon, the improvement comprising a body loop for encircling the body of an individual carrying the weapon, said body loop having a lower end and an upper end passing over one of said individual's shoulders, said body loop also having a lower attachment means located at said lower end of said body loop for attachment near the lower or butt end of a weapon, a first release clasp means affixed to said body loop near its upper end, an extension strap having a first end affixed to said body loop near said upper end and a further distant end on which is mounted an upper attachment means for attachment to the upper or forearm area of the weapon, a second release clasp means adapted to engage and clasp with said first release clasp means and mounted near the upper or forearm area of the weapon wherein the first and second clasp means are clasped to form a loop of said extension strap when carrying the weapon and released to allow the weapon forearm to be extended away from the body for firing the weapon, said sling being attached to the lower end of the weapon by lower sling attachment means mounted on said threaded tube near said receiver and having a hole through which the said threaded end of said tube is passed, said lower sling attachment means having sling mount means on at least one side thereof to which the lower end of a weapon sling is attached.

13. A weapon carrying and firing sling for use in the M16 type rifle and M-4 type carbine utilizing a front sight having at least one elongated leg extending at one end from near the end of the barrel of the weapon to, at its other end, the front sight of the weapon and having right and left sides with respect to the weapon, the improvement comprising a body loop for encircling the body of an individual carrying the weapon, said body loop having a lower end and an upper end passing over one of said individual's shoulders, said body loop also having a lower attachment means located at said lower end of said body loop for attachment near the lower or butt end of a weapon, a first release clasp means affixed to said body loop near its upper end, an extension strap having a first end affixed to said body loop near said upper end and a further distant end on which is mounted an upper attachment means for attachment to the upper or forearm area of the weapon, a second release clasp means adapted to engage and clasp with said first release clasp means and mounted near the upper or forearm area of the weapon wherein the first and second clasp means are clasped to form a loop of said extension strap when carrying the weapon and released to allow the weapon forearm to be extended away from the body for firing the weapon, an upper sling attachment adapter encircling and clamping said elongated leg and extending at least partially along said leg, said upper sling attachment adapter having upper sling mount means affixed thereto to which the upper attachment means of the weapon sling is attached, said upper sling mount means being suspended by said upper sling attachment adapter and extending away from said leg so that the upper end of the weapon sling is held away from the sight line of the front sight.

14. A weapon carrying and firing sling for use in the M16 type rifle and M-4 type carbine utilizing a rear or butt stock mounted on a tube, one end of which tube is threaded into the rear of the receiver of the weapon and having a front sight having at least one elongated leg extending at one end from near the end of the barrel of the weapon to, at its other end, the front sight of the weapon and having right and left sides with respect to the weapon, the improvement comprising a body loop for encircling the body of an individual carrying the weapon, said body loop having a lower end and an upper end passing over one of said individual's shoulders, said body loop also having a lower attachment means located at said lower end of said body loop for attachment near the lower or butt end of a weapon, a first release clasp means affixed to said body loop near its upper end, an extension strap having a first end affixed to said body loop near said upper end and a further distant end on which is mounted an upper attachment means for attachment to the upper or forearm area of the weapon, a second release clasp means adapted to engage and clasp with said first release clasp means and mounted near the upper or forearm area of the weapon wherein the first and second clasp means are clasped to form a loop of said extension strap when carrying the weapon and released to allow the weapon forearm to be extended away from the body for firing the weapon, said lower attachment means being attached to the lower end of the weapon by a lower sling attachment adapter mounted on said threaded tube near said receiver and having a hole through which the said threaded end of said tube is passed, said lower sling attachment adapter having sling mount means on at least one side thereof to which said lower attachment means of the weapon sling is attached, an upper sling attachment adapter encircling and clamping said elongated leg and extending at least partially along said leg, said upper sling attachment adapter having upper sling mount means affixed thereto to which the upper attachment means of the weapon sling is attached, said upper sling mount means being suspended by said upper sling attachment adapter and extending away from said leg so that the upper end of the weapon sling is held away from the sight line of the front sight.

* * * * *